US007059884B2

(12) United States Patent
Hisaeda et al.

(10) Patent No.: US 7,059,884 B2
(45) Date of Patent: Jun. 13, 2006

(54) ELECTRICAL CONNECTION STRUCTURE FOR CONDUCTOR FORMED ON GLASS SURFACE

(75) Inventors: Katsumi Hisaeda, Aiko-gun (JP); Shoichi Takeuchi, Aiko-gun (JP)

(73) Assignee: Asahi Glass Company, Limited, Tokyo (JP)

( * ) Notice: Subject to any disclaimer, the term of this patent is extended or adjusted under 35 U.S.C. 154(b) by 0 days.

(21) Appl. No.: 11/138,425

(22) Filed: May 27, 2005

(65) Prior Publication Data

US 2005/0221657 A1 Oct. 6, 2005

Related U.S. Application Data

(63) Continuation of application No. PCT/JP03/14527, filed on Nov. 14, 2003.

(30) Foreign Application Priority Data

Nov. 28, 2002 (JP) ..... 2002-345747

(51) Int. Cl.
*H01R 13/62* (2006.01)

(52) U.S. Cl. ..... 439/329

(58) Field of Classification Search ..... 439/329
See application file for complete search history.

(56) References Cited

U.S. PATENT DOCUMENTS 3,744,009 A * 7/1973 Teagno et al. ..... 439/329
3,981,556 A * 9/1976 Sabatelli et al. ..... 439/874
4,023,008 A * 5/1977 Durussel ..... 219/522
4,060,295 A * 11/1977 Tomkiewicz ..... 439/55
4,072,387 A * 2/1978 Sochor ..... 439/329
4,246,467 A * 1/1981 Boaz ..... 219/522
4,425,021 A * 1/1984 Nicolino ..... 439/874
4,707,591 A 11/1987 Sprenger
4,864,316 A * 9/1989 Kaoru et al. ..... 343/704
5,015,197 A * 5/1991 Redmond et al. ..... 439/329
5,188,534 A 2/1993 Bertho et al.
5,199,896 A * 4/1993 Mosquera ..... 439/329
5,208,444 A * 5/1993 Winter et al. ..... 219/547
5,232,373 A * 8/1993 Sawada ..... 439/140
5,260,549 A * 11/1993 Garritano ..... 219/541
5,268,700 A * 12/1993 Hirotsu et al. ..... 343/713
5,676,562 A * 10/1997 Fukuda ..... 439/329
5,891,591 A * 4/1999 Suzuki ..... 429/178
5,928,455 A * 7/1999 Dizin et al. ..... 156/276

(Continued)

FOREIGN PATENT DOCUMENTS

JP 50-535 1/1975

(Continued)

*Primary Examiner*—Ross Gushi
(74) *Attorney, Agent, or Firm*—Oblon, Spivak, McClelland, Maier & Neustadt, P.C.

(57) ABSTRACT

A conductor formed on a glass surface and a lead wire are electrically connected by a structure constituted by a small number of parts, which requires no soldering and achieves space-saving and low cost.

An electrical connection structure for a conductor formed on a glass surface, comprising a conductor 2 formed on a glass surface, a cover member 5 made of an electrically insulating material forming a cavity 17 between the cover member 5 and the glass surface and having an insertion slot 11 communicating with the cavity 17, and a connection member 3 made of an electrically conductive material having elasticity and inserted into the insertion slot 11, wherein the connection member 3 and the conductor 2 are pressed to each other by the elasticity of the connection member 3 whereby they are electrically connected.

6 Claims, 3 Drawing Sheets

U.S. PATENT DOCUMENTS

| | | | | |
|---|---|---|---|---|
| 5,938,957 | A * | 8/1999 | Tanahashi et al. | 219/219 |
| 5,997,329 | A * | 12/1999 | Kosmala | 439/260 |
| 6,007,359 | A * | 12/1999 | Kosmala | 439/329 |
| 6,103,998 | A * | 8/2000 | Kuno et al. | 219/203 |
| 6,164,984 | A * | 12/2000 | Schreiner | 439/86 |
| 6,217,396 | B1 * | 4/2001 | Hwang et al. | 439/862 |
| 6,257,912 | B1 * | 7/2001 | Boillot et al. | 439/329 |
| 6,267,630 | B1 * | 7/2001 | Machado | 439/876 |
| 6,343,960 | B1 * | 2/2002 | Sato | 439/701 |
| 6,379,176 | B1 * | 4/2002 | Ohsawa et al. | 439/495 |
| 6,551,150 | B1 * | 4/2003 | Machado | 439/876 |
| 6,589,082 | B1 * | 7/2003 | Harasawa et al. | 439/752 |
| 6,638,075 | B1 * | 10/2003 | Spaulding et al. | 439/34 |
| 6,676,455 | B1 * | 1/2004 | Machado | 439/855 |
| 6,781,230 | B1 * | 8/2004 | Tsukamoto | 257/700 |
| 6,790,104 | B1 * | 9/2004 | Antaya et al. | 439/862 |
| 6,793,120 | B1 * | 9/2004 | Johnson | 228/122.1 |
| 2002/0111081 | A1 * | 8/2002 | Machado | 439/876 |
| 2003/0162415 | A1 * | 8/2003 | Spaulding et al. | 439/34 |
| 2004/0237302 | A1 * | 12/2004 | Antaya et al. | 29/874 |

FOREIGN PATENT DOCUMENTS

| | | | |
|---|---|---|---|
| JP | 50-535 | Y1 | 1/1975 |
| JP | 63-182469 | | 11/1988 |
| JP | 6-68941 | | 3/1994 |
| JP | 6-68941 | A | 3/1994 |
| JP | 9-102406 | | 4/1997 |
| JP | 9-102406 | A | 4/1997 |
| JP | 10-40977 | | 2/1998 |
| JP | 10-40977 | A | 2/1998 |

* cited by examiner

ELECTRICAL CONNECTION STRUCTURE FOR CONDUCTOR FORMED ON GLASS SURFACE

TECHNICAL FIELD

The present invention relates to an electrical connection structure for a conductor formed on a glass surface, for electrically connecting a conductor formed on a glass surface with a lead wire.

BACKGROUND ART

Various functions are added to a window glass for automobiles in recent years. In particular, to a rear window glass, an antenna function for receiving e.g. AM, FM or TV waves, or a defog function for defogging the window glass, is added by forming a baked silver paste on the glass surface. In order to exhibit these functions, it is necessary to supply electricity via a bus bar portion made of a baked silver paste. The supply of electricity is achieved by soldering a terminal having a shape shown as PA or PV type flat-type male terminal for automobiles defined by JIS-D5403 to the bus bar portion, and by connecting a connector connected with a lead wire, with the terminal.

FIG. 5 is a perspective view showing a conventional structure in that a terminal 43 is soldered to a baked silver paste 2 and connected with a lead wire 6. In this case, the baked silver paste 2 and the lead wire 6 can be connected by connecting a connector 7 with the lead wire 6 and connecting the connector 7 with the terminal 43. Further, by pressing a switch 18 provided on the connector 7, the connector 7 can be disconnected from the terminal 43.

However, since the terminal 43 is attached to the baked silver paste 2 by soldering, there is a risk that the strength of the glass can be reduced by a thermal shock at the time of soldering.

Further, since the solder used for a window glass for automobiles usually contains lead, much work is needed in treating the solder containing lead at a time of disposing the glass. Moreover, as in the ELV (End Life of Vehicle) order and WHEE&RoHS (Waste Electrical and Electronic Equipment & Restriction of the use of certain Hazardous Substances in electrical and electronic equipment) order in Europe, for example, regulations regarding the use of a solder containing lead are being considered in many countries and it is becoming impossible to use a solder containing lead.

Further, since the terminal 43 is attached to the bus bar portion in a bare state, it affects the external appearance and it is necessary to improve the design.

Therefore, a connection method of a terminal without employing a solder has been requested and proposed. For example, the specification of U.S. Pat. No. 4,707,591 discloses a method of pressing a bus bar portion of a glass surface against a contactor attached to a body-flange of an automobile and having a coil spring, to strongly contact the contactor with the bus bar portion by a reaction force of the coil spring so as to electrically connect them.

Further, JP-A-10-40977 discloses a method of bonding a base member to a bus bar portion on a glass surface, making an intervening terminal contact with the bus bar portion, placing a pressing member on the intervening terminal and fitting a cover member to the base member, so that by a pressing force of the pressing member, the intervening terminal is pressed against and held by the bus bar portion, to obtain an electrical connection with the bus bar portion.

However, according to the invention described in the specification of U.S. Pat. No. 4,707,591, the structure of the body becomes complicated in terms of attaching the contactor to the body flange, and since there is an individual difference of glass sheets in the radius, the degree of pressing of the contactor against the bus bar portion changes, which has been making the design of body complicated. Further, it has been necessary to consider a short circuit with the body.

The invention described in JP-A-10-40977 does not have the problem as in the invention described in the specification of U.S. Pat. No. 4,707,591 since it does not use the body. However, since the structure is composed of many parts and its assembly is complicated, it costs much, and insertion and pulling-off of the intervening terminal is difficult.

Under these circumstances, it is an object of the present invention to provide an electrical connection structure for a conductor formed on a glass surface, which electrically connects the conductor formed on a glass surface with a lead wire without requiring soldering, and which comprises a small number of parts, and achieves space-saving and low cost.

DISCLOSURE OF THE INVENTION

The present invention provides, in order to solve the above problems, an electrical connection structure for a conductor formed on a glass surface, comprising a conductor formed on a glass surface, a cover member provided to cover at least a part of the conductor, forming a cavity between the cover member and the glass surface and having an insertion slot communicated with the cavity, and a connection member inserted into the insertion slot made of an electrically conductive material having elasticity, wherein the connection member presses the conductor by being elastically deformed in the cavity, whereby the connection member and the conductor are electrically connected.

The present invention is based on the idea of providing a cover member on a glass surface, inserting a connection member into a cavity formed by the cover member so as to elastically deform the connection member and pressing a conductor formed on a glass surface with the connection member to make them contact electrically. Since the above-mentioned construction does not require soldering, various problems caused by employing solder can be solved, and an exchange of parts is easy.

Further, it is preferred that the cover member and the connection member have respectively a structure fitting or engaging with each other. By fitting or engaging the cover member and the connection member with each other, disconnection of the connection member due to an external force can be prevented and the connection between the connection member and the conductor can be stabilized.

Further, it is preferred that one end of the connection member has elasticity and the other end of the connection member is a male type or female type terminal for a connector connected with a lead wire. When the connection member has a male type or female type terminal used conventionally, a conventional connector of a lead-wire-side can be used and no procurement of new parts or capital investment is necessary.

Alternatively, it may be such that one end of the connection member has elasticity and the other end of the connection member is connected with a lead wire by caulking. If the connection member is directly connected with a lead wire, it is possible to reduce the number of parts and lower the cost.

Further, it is preferred that a contact portion of the connection member to be in contact with the conductor be applied with a metal plating at the surface. By applying the connection member with a metal plating, it becomes possible to stabilize the connection with the conductor for long period of time.

Further, the conductor is preferably of a baked silver paste, and the conductor is preferably formed on a window glass for automobiles. Since conductors made of a baked silver paste provided on many window glasses for automobiles, are connected with terminals by soldering, various problems due to employing of solder can be solved by applying the construction of the present invention.

The present invention provides an electrical connection structure for a conductor on a glass surface, without employing solder.

BEST MODE FOR CARRYING OUT THE INVENTION

Now, an embodiment of the present invention will be described with employing drawings.

Figure 1:
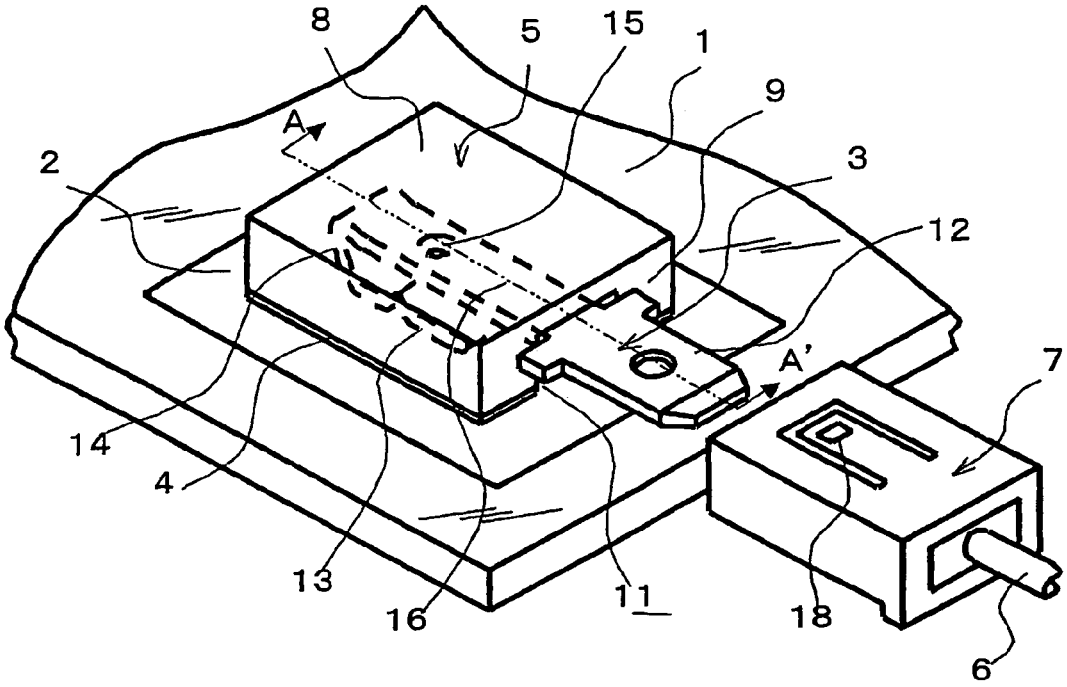
FIG. 1: a perspective view showing an embodiment of the present invention employing a conventional connector.
Figure 2:
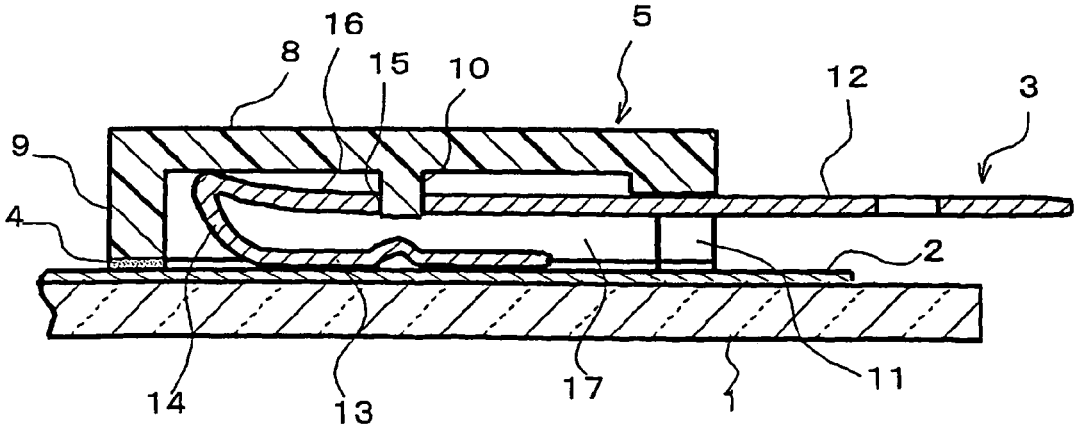
FIG. 2: a cross sectional view along a line A–A' of FIG. 1.

FIG. 1 is a perspective view showing an example of Embodiment 1 employing a conventional connector of lead-wire-side as it is, and. FIG. 2 is a cross sectional view along a line A–A' of FIG. 1. As shown in FIGS. 1 and 2, Embodiment 1 is constituted by a glass sheet 1 on which a conductor 2 is formed, a terminal member 3 made of an electrically conductive material, a cover member 5 pressing and holding by engagement the terminal member 3 and bonded to the glass surface 1 and/or the conductor 2 via an adhesive layer 4 so as to cover at least a part of the conductor 2, and a connector 7 for a terminal member 3 connected with an end of a lead wire 6.

The cover member 5 bonded to the glass surface 1 and/or the conductor 2 via the adhesive layer 4, is constituted by a plate-shaped ceiling 8, a side wall 9 extending vertically from the periphery of the ceiling 8 and bonded to the glass surface 1 and/or the conductor 2 via an adhesive layer 4, a fitting portion 10 having a protrusion at the center of a surface of the ceiling 8 on a side of the side wall 9, and an insertion slot 11 formed by providing a gate-shaped notch on a part of the side wall 9 for inserting a terminal member 3 into the cover member 5.

One end of the terminal member 3 is constituted by a terminal 12 of PA or PB type defined by JIS-D5403, and the other end of the terminal member 3 is constituted by a contact portion 13 to be in contact with the conductor 2, an elastic portion 14 having elasticity, and an insertion portion 16 having a fitting hole 15 for positioning the cover member 5 by being fitted to the fitting portion 10 of the cover member 5 and holding the cover member 5.

The elasticity of the elastic portion 14 can be obtained by forming the insertion portion 16 to have a substantially acuate cross-sectional shape so as to have elasticity in a direction perpendicular to the conductor 2. Further, the height of the elastic portion 14 in a free space is higher than the height of the cavity 17 formed between the cover member 5 and the conductor 2.

The elasticity of elastic portion 14 is used for connecting the terminal member 3 and the cover member 5. The insertion portion 16 is forced into the insertion slot 11 under elastic deformation of the elastic portion 14 until the height of the elastic portion 14 becomes lower than the height of the insertion slot 11, and the fitting portion 10 of the cover member 5 and the fitting hole 15 of the insertion portion 16 are fit and fixed together. The fitting serves as positioning, and the insertion portion 16 is pressed against the conductor 2 and the ceiling 8 by a reaction force of the elastic portion 14, whereby the insertion portion 16 does not disengage from the fitting with the cover member 5. Further, the contact portion 13 is strongly pressed against the conductor 2 by the reaction force of the elastic portion 14, whereby a stable connection can be obtained. Therefore, by making the construction of the present invention, the conductor 2 and the terminal member 3 can be electrically connected without employing solder.

Meanwhile, the connector 7 on the side of the lead wire 6 is a female-type connector complying with JIS-D-5403 CW type plug receptacle for automobiles which has been conventionally used. By connecting the connector with the terminal 12 of the terminal member 3, the lead wire 6 and the conductor 2 on the glass sheet 1 can be connected.

Figure 3:
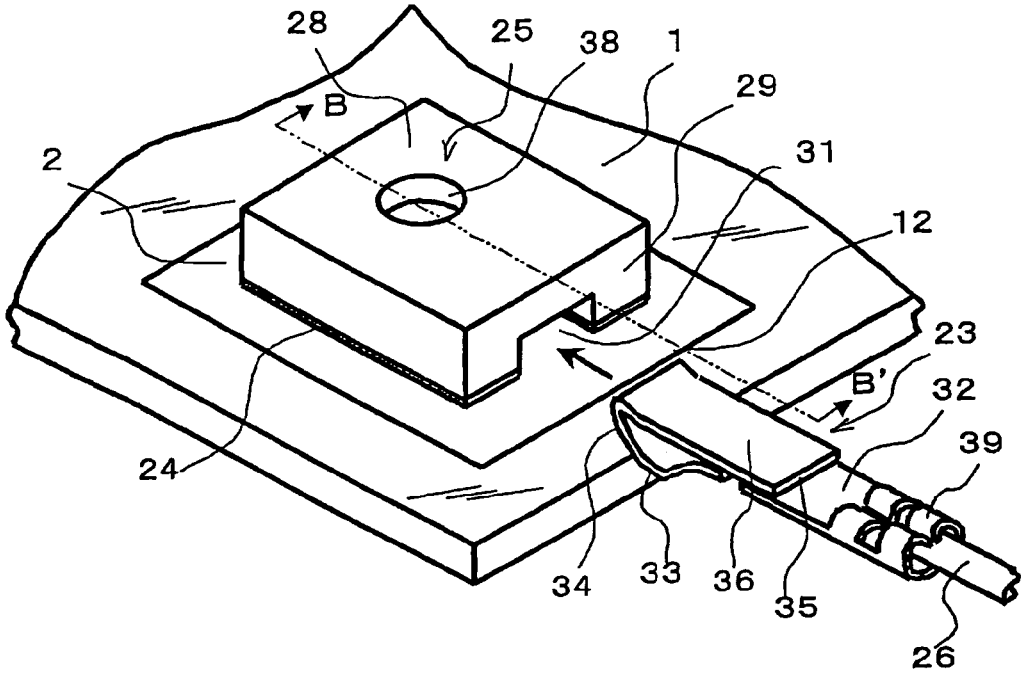
FIG. 3: a perspective view showing an embodiment of the present invention without employing a conventional connector.
Figure 4:
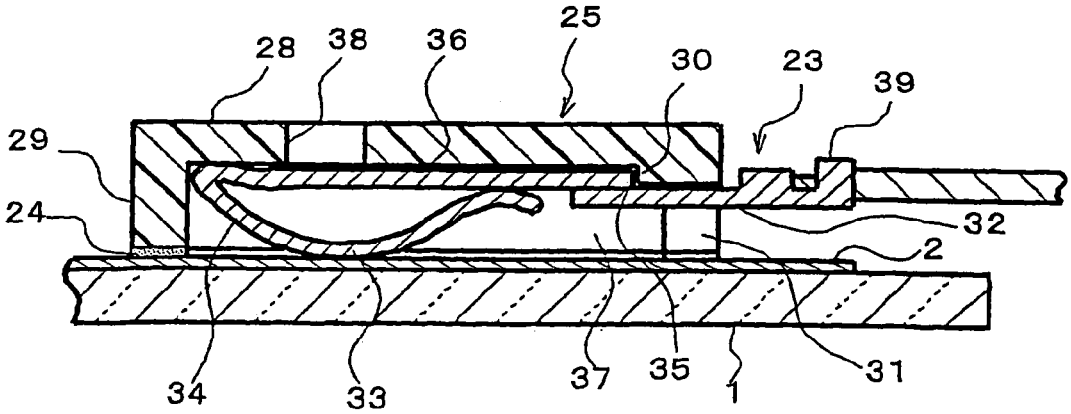
FIG. 4: a cross sectional view along a line B–B' of FIG. 3 in a state that a terminal member is inserted into an insertion slot.
Figure 5:
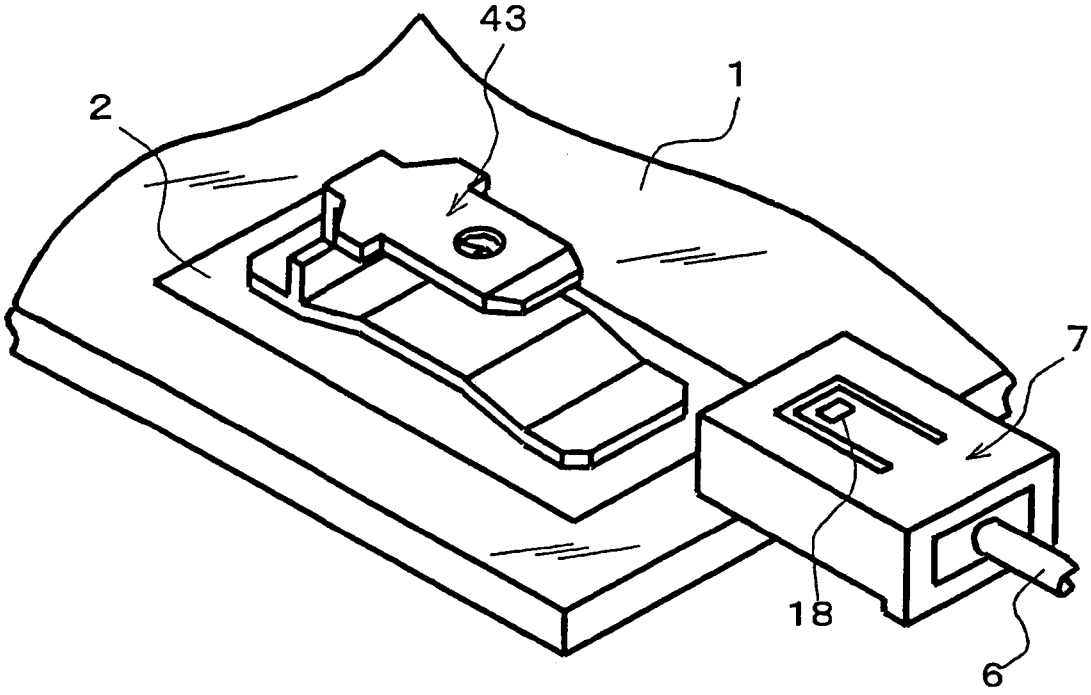
FIG. 5: a view showing another conventional electrical connection device to a conductor on a glass surface.

FIG. 3 is a perspective view showing an example of Embodiment 2 not employing a conventional connector usable at the side of the lead wire, and FIG. 4 is a cross sectional view along a line B–B' of FIG. 3 in a state that the insertion member 36 is inserted. The same reference numerals are used for the parts in common with FIG. 1 or 2. As shown in FIGS. 3 and 4, Embodiment 2 is constituted by a glass sheet 1 on which a conductor 2 is formed, a terminal member 23 provided at an end of a lead wire 26 made of an electrically conductive material, and a cover member 25 for pressing and latching the terminal member 23, and bonded to the surface of the glass sheet 1 or/and the conductor 2 via an adhesive layer 24.

The cover member 25 bonded to the surface of the glass sheet 1 or/and the conductor 2 via the adhesive layer 24, is constituted by a plate-shaped ceiling 28, a side wall 29 vertically extending from the periphery of the ceiling 28 and bonded to the surface of the glass sheet 1 and/or the conductor 2 via the adhesive layer 24, a through hole 38 provided approximately at the center of the ceiling 28, an insertion slot 31 formed by providing a gate-shaped notch at a part of the side wall 29 and allowing insertion of the terminal member 23 into the cover member 25, and a cover-member-side engage portion 30 formed by making the height of the insertion slot 31 lower than the height of the cavity 37 formed between the cover member 25 and the glass sheet 1.

One end of the terminal member 23 comprises an intermediate member 32 having at one end a crimping portion or connector in the form of a clamping member 39 to be connected with a lead wire by crimping and having a plate-shaped portion at the other end, and an insertion member 36 bonded to the plate-shaped portion of the intermediate member 32, which is constituted by a contact portion 33 to be in contact with the conductor 2 and an elastic portion 34 having elasticity. Further, the terminal member 23 has a terminal-side engage portion 35 having a step shape formed by bonding the insertion portion 36 and the intermediate portion 32.

The elasticity of the elastic portion 34 can be obtained by forming the insertion member 36 to have a substantially acuate cross sectional shape so as to have elasticity in a vertical direction with respect to the conductor 2. Further, the height of the elastic member 34 in a free space is higher than the height of the cavity 37 formed between the cover member 25 and the conductor 2.

To connect the terminal member 23 and the cover member 25, the elasticity of the elastic portion 34 is used. The insertion member 36 is forced into the insertion slot 31 under elastic deformation of the elastic portion 34 until the height of the elastic portion 34 becomes lower than the height of the insertion slot 31, and the cover-member-side engage portion 30 and the terminal-side engage portion 35 are engaged together. After the insertion, the terminal member 23 is pressed against the conductor 2 and the ceiling 28 by the reaction force of the elastic portion 34, whereby it does not disengage from the fitting with the cover member 25. Further, the contact portion 33 is strongly pressed against the conductor 2 by the reaction force of the elastic portion 34, which provides a stable connection. Therefore, according to the construction of the present invention, the conductor 2 and the terminal member 23 are electrically connected without using a solder.

Here, by squashing the terminal member 23 through the through hole 38, the engagement between the cover member 25 and the terminal member 23 are released, and then the terminal member 23 can be disconnected by pulling it in the direction opposite to the inserting direction.

In Embodiments 1 and 2, the shape and the size of the cover members 5 and 25 and the terminal members 3 and 23 are not limited to those described above. For example, the external shapes of the cover members 5 and 25 may be round shapes to escape from an external force even if it is applied thereto, or to improve their design. Further, the cover members 5 and 25 may be colored to improve their appearances. Further, the cover members 5 and 25 may have a structure in which a plurality of the terminal members 3 or 23 can be inserted. Further, the fitting and engaging structure of each of the cover members 5 and 25 and terminal members 2 and 23 are not limited to Embodiments 1 and 2.

The material of the cover members 5 and 25 is not particularly limited and is determined considering the durability or adhesiveness with the adhesive material forming the adhesive layers 4 and 14. For example, a polyamide resin is mentioned. Further, the production process may be a cutting or an injection molding and not particularly limited.

The adhesive layers 4 and 14 may, for example, be a double-sided adhesive material (double-sided tape), a thermosetting adhesive agent or a thermoplastic adhesive agent. One having a durability sufficient for long time use against the elasticities of the terminal member 3 and the terminal member 13, should be selected. When a double-sided adhesive material is employed, the thickness of the adhesive layer is determined considering the size of the terminal member 3 or 23 within a range in which the elasticity of the elastic portion 14 or 34 can be used. In a case of using an adhesive agent, attention be paid to prevent it from flowing out on the conductor 2 or to prevent it from generating a gas affecting the terminal members 3 and 23, the conductor 2 and contact between them. Therefore, a double-sided adhesive material is more preferable considering the productivity and workability.

Material of the terminal members 3 and 23 are not particularly limited so long as it is an electrically conductive material. However, considering the long-term stability or the compatibility with the conductor 2, at least the contact portions 13 and 33 are preferably applied with plating of a metal such as gold, silver, tin or nickel. Particularly, the contact portions 13 and 33 to be in contact with these conductors 2 are preferably applied with metal plating. For the metal plating, it is preferred to consider the material of the conductor 2 and environmental impact at a time of disposal. In particular, when the conductor 2 is a conductor formed by baking a silver paste, silver plating is preferred.

Now, Examples are specifically described. Example 1 is an example of implementing Embodiment 1, and Example 2 is an example of implementing Embodiment 2.

EXAMPLE 1

A cover member 5 having the shape shown in FIGS. 1 and 2 was made by cutting a polyamide resin having a size of 18 mm×12 mm and a thickness of 4 mm. Further, as an adhesive layer 4, a double-sided adhesive tape (manufactured by Sumitomo 3M Limited) of 0.4 mm thick cut into a shape corresponding to the bonding surface of the cover member 5, was employed to bond the cover member 5 at a predetermined position of the conductor 2 formed by baking a silver paste on a glass sheet 1.

The terminal member 3 comprises an insertion portion made of a beryllium copper of 0.3 mm thick and a terminal portion 12 made of a bronze of 0.8 mm thick welded to the insertion portion. The terminal portion 3 has a size complying with JIS-D5403 PA type male blade (with shoulders) for automobiles. The insertion portion has a width of 4.5 mm, a length of 10 mm and a height in a free space of 3.0 mm.

The terminal member 3 was inserted into the insertion slot 11 by pushing the insertion portion 16 under elastic deformation of the elastic portion 14 until the height of the elastic portion 14 becomes lower than the height of the cover member 5 at the insertion slot 11, and until the fitting portion 10 of the cover member 5 and the fitting hole 15 of the insertion portion 16 were fit together to be fixed.

In this state, the contact resistance between the conductor 2 and the terminal member 3 was measured and found it to be at most 0.005 Ω which was sufficient for practical use even as compared with conventional examples, and the contact resistance remained good even through an environmental test.

EXAMPLE 2

A cover member 25 having the shape shown in FIGS. 3 and 4 was made by cutting a polyamide resin having a size of 16 mm×15 mm and a thickness of 2.6 mm. Further, as an adhesive layer 24, a double-sided adhesive tape (manufactured by Sumitomo 3M Limited) of 0.4 mm thick cut into a shape corresponding to the bonding surface of the cover member 25, was employed to bond the cover member 25 at a predetermined position of a conductor 2 formed by baking a silver paste on a glass sheet 1.

The terminal member 23 comprises an insertion member made of a beryllium copper of 0.2 mm thick and a caulking portion 39 made of bronze of 0.3 mm thick welded to the insertion member. The insertion member has a width of 4.3 mm, a length of 10 mm and a height in a free space of 2.5 mm. Further, the caulking portion 39 has a length of 10 mm, a width of about 3.5 mm and a height of about 3 mm when it is caulked or crimped together with a lead wire 26.

The terminal member 23 was pushed into the insertion slot 31 by pushing the insertion member 36 under elastic deformation of the elastic portion 34 until the height of the elastic portion 34 became lower than the height of the cover member 25 at the insertion slot 31, and until the cover-member-side engage portion 30 and the terminal-side engage portion 35 were engaged together.

In this state, the contact resistance between the conductor 2 and the terminal member 23 was measured and found it to be at most 0.005 Ω which was sufficient for practical use even as compared with conventional examples, and the contact resistance remained good even through an environmental test.

INDUSTRIAL APPLICABILITY

As described above, the present invention provides the following effects. A cover member is bonded to a conductor in advance. Therefore, by simply inserting a terminal member, the terminal member can be pressed against the conductor due to the elasticity of the terminal member to realize a stable electrical connection. Further, since the structure is simple and constituted by a small number of parts, the work can be simplified, the cost can be kept low and space can be saved since the connection structure is small-sized.

Further, since an electrical connection with the conductor formed on a glass surface can be achieved without using a solder, it becomes unnecessary to consider the disposal process of solder, which contributes to cut the cost for disposal process and prevents lowering of the strength of the glass due to a thermal shock caused by soldering. Further, since the terminal is not bare as in the case of soldering, external appearance can be improved.

The entire disclosure of Japanese Patent Application No. 2002-345747 filed on Nov. 28, 2002 including specification, claims, drawings and summary is incorporated herein by reference in its entirety.

What is claimed is:

1. An electrical connection structure for a conductor formed on a glass surface, comprising a conductor formed on a glass surface, a cover member provided to cover at least a part of the conductor, forming a cavity between the cover member and the glass surface and having an insertion slot communicated with the cavity, and a connection member inserted into the insertion slot made of an electrically conductive material having elasticity, wherein the connection member presses the conductor by being elastically deformed in the cavity whereby the connection member and the conductor are electrically connected, said connection member including a portion extending from said cover member for connection to a connector having a lead wire attachable thereto.

2. The electrical connection structure for a conductor formed on a glass surface according to claim 1, wherein each of the cover member and the connection member has a structure fitting or engaging with each other.

3. The electrical connection structure for a conductor formed on a glass surface according to claim 1, wherein one end of the connection member has elasticity and the other end of the connection member is a male type or female type terminal for the connector and the connector is connected with a lead wire.

4. The electrical connecting structure for a conductor formed on a glass surface according to claim 1, wherein a contact portion of the connection member to be in contact with the conductor is applied with metal plating at the surface.

5. The electrical connecting structure for a conductor formed on a glass surface according to claim 1, wherein the conductor is of a baked silver paste.

6. The electrical connection structure for a conductor formed on a glass surface according to claim 1, wherein the conductor is formed on a window glass for automobiles.

* * * * *